United States Patent [19]

Röck et al.

[11] 3,969,787

[45] July 20, 1976

[54] HINGE DEVICE

[75] Inventors: Erich Röck, Höchst; Bernhard Mages, Dornbirn, both of Austria

[73] Assignee: Blum Gesellschaft m.b.H., Hochst, Austria

[22] Filed: July 17, 1975

[21] Appl. No.: 596,809

Related U.S. Application Data

[63] Continuation of Ser. No. 533,745, Dec. 18, 1974, abandoned.

[30] Foreign Application Priority Data

Dec. 24, 1973 Austria ..... 10792/73

[52] U.S. Cl. ..... 16/129

[51] Int. Cl.[2] ..... E05D 7/04

[58] Field of Search ..... 16/128 R, 129–132

[56] References Cited

UNITED STATES PATENTS

| | | | |
|---|---|---|---|
| 3,596,307 | 8/1971 | Kolmetsky | 16/129 |
| 3,772,735 | 11/1973 | Lautenschlaeger | 16/129 |
| 3,913,173 | 10/1975 | Rock et al. | 16/130 |

*Primary Examiner*—George V. Larkin

*Attorney, Agent, or Firm*—Wenderoth, Lind & Ponack

[57] ABSTRACT

A hinge device including a hinge arm which embraces an intermediate part lockable on a mounting plate, the intermediate part having hook members or catches which rest in the mounting plate, and a counteracting clamping screw and adjustment means for the hinge arm, the hinge arm or the hinge arm and the intermediate part being broader than the mounting plate.

9 Claims, 4 Drawing Figures

HINGE DEVICE

This is a (X) Continuation, of application Ser. No. 533,745, filed Dec. 18, 1974, now abandoned.

BACKGROUND OF THE INVENTION

The invention relates to a hinge device including a mounting plate to be fixed e.g. on the side wall of a piece of furniture, a hinge arm directly or indirectly connected with the mounting plate and provided with swivel pin bearings and with a cross section that embraces the mounting plate like a U, and an intermediate part situated between the mounting plate and the hinge arm.

The conventional hinge devices of the above type offer the advantage that certain discrepancies which inevitably occur during assemblage of the mounting plate can be levelled out or adjusted after the assemblage of the piece of furniture, i.e. when the doors are mounted, because the intermediate part is adjustable with respect to the hinge arm.

The adjustment possibilities which are known up to now are those in direction of the depth of the furniture and in the lateral vertical door gap, i.e. the gap between the door and the furniture side wall.

These conventional hinge devices do not, however, permit an adjustment in the height, and therefore the mounting of the mounting plate must be executed with extreme accuracy as to this respect.

The lack of the possibility of adjustment in this direction must be regarded as a serious disadvantage insofar as it eliminates many of the advantages of the existing adjustment possibilities, as some adjustment work has to be done previously (on the occasion of the assemblage of the mounting plate), and it is not of major importance whether the adjustment in one or two or three directions is carried out exactly or only approximately.

SUMMARY OF THE INVENTION

Therefore the object of the invention is to provide a hinge device of the above mentioned type, but which; also may be adjusted in the direction of the height after assemblage.

According to the invention this is achieved by the provision of a device wherein the open width of the hinge arm exceeds the breadth of the mounting plate by a predetermined distance, that the intermediate part is provided with hook members which engage the mounting plate, the breadth of the hook members being equal to the open width of the hinge arm, the hook members engaing recesses in the mounting plate which are preferably formed by projections, and that the intermediate part is provided with a clamping screw that abuts against the mounting plate when the intermediate part is fixed.

Preferably the hook members are provided as catches which are pivotally connected to the intermediate part by bolts or pins.

In order to insure that the catches snap into the recesses, springs are provided to abut against the intermediate part and to act upon the catches.

A further possibility is to construct the hook members as plate- or leg-springs which press against the front sides of the mounting plate and which are provided with hooks at their outer ends, such hooks snapping into recesses formed by projections of the mounting plate.

In order to provide for the adjustability in the direction of the depth of the furniture as well as in the door gap, an adjustment part is provided between the intermediate part and the hinge arm. This adjustment part is connected with the intermediate part by means of an adjustment screw and has a fixing screw to clamp or fasten the hinge arm onto the adjustment part.

In this case the adjustment part embraces the intermediate part like a U.

A preferred embodiment is characterized in that the hinge arm has slots which receive the fixing screw and preferably also the adjustment screw and thus permit the adjustment of the hinge arm in the direction of the depth of the furniture.

BRIEF DESCRIPTION OF THE DRAWINGS

An embodiment of the invention is described hereinafter with reference to the attached drawings, although the invention is not intended to be restricted to this specific embodiment.

DETAILED DESCRIPTION OF THE INVENTION

Figure 1:
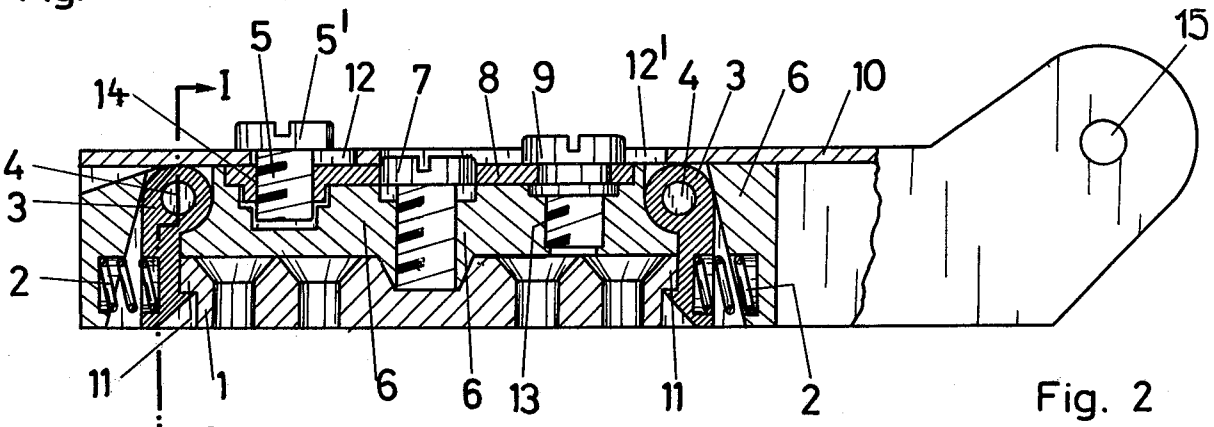
FIG. 1 is a longitudinal section of a hinge device according to the invention.

As can be seen especially from FIG. 1, the hinge arm 10 includes a mounting plate 1 with recesses formed by projections 11 on its two front sides, into which recesses hook members, such as catches 3, of the intermediate part 6 extend.

The mounting plate 1 can be fastened onto the furniture side wall 17 in any conventional way, as e.g. by screws or dowels, but in the present specification the particular manner of fastening is not dealt with any further, as it is known to everyone skilled in the art.

Figure 2:
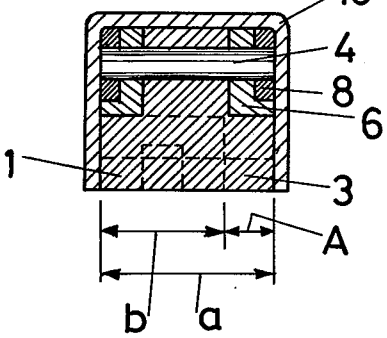
FIG. 2 is a section along the line I — I of FIG. 1.
Figure 3:
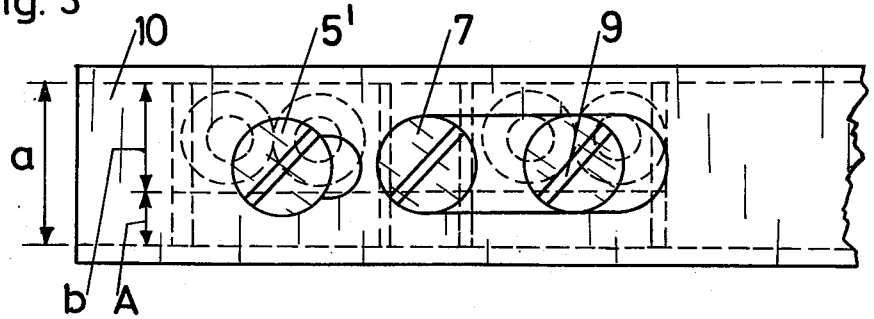
FIG. 3 is a top elevational view of a hinge device according to the invention.
Figure 4:
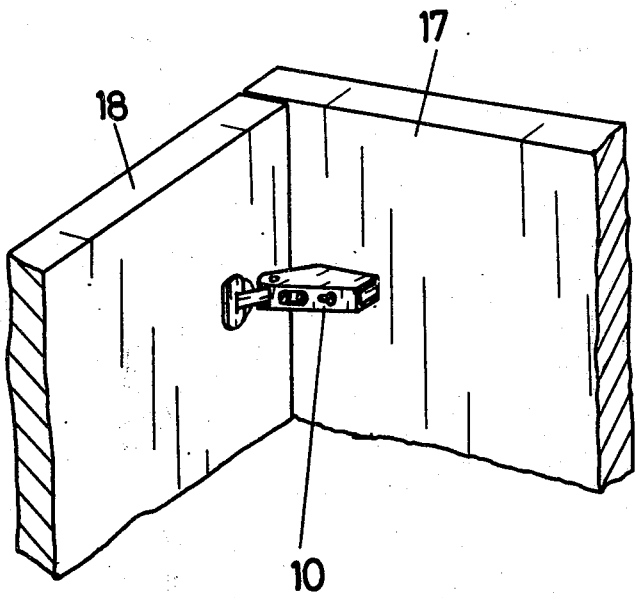
FIG. 4 is a perspective view of a part of a furniture door mounted onto a furniture side wall by means of a hinge according to the invention.

As can be seen from FIGS. 2 and 3, the open width a of the cross section of the hinge arm 10 exceeds the breadth b of the mounting plate 1. In the illustrated embodiment the intermediate part 6 has also a breadth that corresponds to the open width of the hinge arm 10.

The intermediate part 6 has thereon hook members, such as catches 3 that are pivotally connected to part 6, by bolts or pins 4, the breadth of catches 3 also being equal to the open width a of the hinge arm 10.

This embodiment permits a lateral displacement of the hinge arm 10 with the intermediate part 6 and the catches 3 by the distance A on and with respect to the mounting plate 1, which fact represents the height adjustment capability of the hinge.

In this case the hinge arm 10 with the intermediate part 6 can be put onto the mounting plate 1 from above, whereby the hook members fit into the recesses in the mounting plate. For example, the catches 3 are pressed over the projections 11 and snap into the recesses, thus holding the hinge arm 10 in place on the mounting plate.

After the height of the hinge arm has been adjusted, the clamping screw 7 is fastened and presses into the mounting plate 1, whereby the position of the intermediate part 6 with respect to mounting plate 1 is fixed by hook members 3 and the clamping screw 7.

In order to insure that the catches 3 snap into the recesses, springs 2 are provided to abut against the intermediate part 6 and to act upon the catches 3.

In the illustrated embodiment the catches 3 are actually urged toward the intermediate part 6.

As can be seen from the drawings the mounting plate 1 is preferably designed to allow attachment thereof to the furniture side wall 17, without paying attention as to which one of its two ends points to the door 18.

As can be seen especially from FIG. 2 the intermediate part 6 has positioned on the top thereof an adjustment part 8 which has a substantially U-shaped configuration. In this case the adjustment part 8 is connected with the intermediate part 6 by an adjustment screw 9 which screws into a thread 13 of the intermediate part 6.

By fastening or loosening the adjustment screw 9 the gap of the furniture door 18 is adjusted. More specifically, fastening or loosening of screw 9 lowers or raises, with respect to intermediate part 6, the adjustment part 8 and thus the hinge arm 10.

Furthermore, the adjustment part 8 has a thread 14 into which extends a fixing screw 5. As can be seen from FIGS. 1 and 3, the fixing screw 5 projects through a slot 12 of the hinge arm 10 and its head 5' abuts against hinge arm 10. If the hinge arm 10 is to be displaced in the direction of the depth of the furniture it is only necessary to loosen the fixing screw 5 in order to displace the hinge arm 10 by the length of the slot 12 in the direction of the depth of the furniture. When the hinge arm 10 is in the desired position, the fixing screw 5 is fastened again, which entails a clamping or fixing of the depth position of the hinge arm 10 with respect to the adjustment part 8.

In order to prevent the adjustment screw 9 of the adjustment part 8 from inhibiting the displacement of hinge arm 10, the hinge arm 10 is provided with a corresponding slot 12' in the area of the head of the adjustment screw 9.

In FIG. 1 of the drawings the bearings 15 for the swivel pins of the hinge are shown, but this part of the hinge and hinge arm will not be dealt with here in further detail, as the hinge device according to the invention can be combined with any conventional hinge or linkage system.

I claim:

1. A hinge device, particularly for mounting a door to a piece of furniture, said device comprising:

a mounting plate adapted to be attached to a piece of furniture, said mounting plate having recesses therein;

an intermediate part positioned on the top of said mounting plate, said intermediate part having hook members received in said recesses, said intermediate part having clamping means extending therethrough into abutment with said mounting plate to fix said intermediate part to said mounting plate;

a hinge arm connected to said intermediate part and having a substantially U-shaped lateral cross-sectional configuration to embrace said mounting plate; and said hinge arm having open opposite ends, the open width of which is greater than the lateral breadth of said mounting plate, the breadth of said hook members being equal to said open width of said open ends of said hinge arm.

2. A device as claimed in claim 1, wherein said recesses are formed by projections extending from opposite ends of said mounting plate.

3. A device as claimed in claim 1, wherein said hook members comprise catches pivotally connected to said intermediate part by pins.

4. A device as claimed in claim 3, further comprising springs positioned in said intermediate part and urging said catches into said recesses.

5. A device as claimed in claim 1, wherein said hook members comprise springs.

6. A device as claimed in claim 1, further comprising an adjustment part positioned between said intermediate part and said hinge arm; an adjsutment screw means fastened to said adjustment part and adjustably extending into said intermediate part for adjusting the spacing between said intermediate part and said adjustment part; and means for adjustably clamping said hinge arm to said adjustment part.

7. A device as claimed in claim 6, wherein said adjustment part has a substantially U-shaped lateral cross-sectional configuration with lateral legs contacting opposite lateral sides of said intermediate part.

8. A device as claimed in claim 6, wherein said adjustable clamping means comprises a first longitudinal slot in said hinge arm, and a clamping screw extending through said first slot and into said adjustment part.

9. A device as claimed in claim 8, further comprising a second longitudinal slot in said hinge arm, said adjustment screw means fitting in said second slot.

* * * * *